United States Patent [19]

Haynes

[11] Patent Number: 4,823,584

[45] Date of Patent: Apr. 25, 1989

[54] ROLL CHANGE ARRANGEMENT FOR BEAM MILL STAND

[75] Inventor: Ralph G. Haynes, Sheffield, England

[73] Assignee: Davy McKee (Sheffield) Limited, Sheffield, England

[21] Appl. No.: 55,285

[22] Filed: May 29, 1987

[30] Foreign Application Priority Data

May 30, 1986 [GB] United Kingdom ..... 8613143

[51] Int. Cl.[4] ..... B21B 13/08; B21B 31/08

[52] U.S. Cl. ..... 72/225; 72/238; 72/239; 72/246

[58] Field of Search ..... 72/225, 238, 239, 237, 72/246

[56] References Cited

U.S. PATENT DOCUMENTS

| | | | |
|---|---|---|---|
| 3,248,919 | 5/1966 | Hewitt et al. | 72/238 |
| 3,566,498 | 3/1971 | Kato et al. | 72/239 X |
| 3,589,161 | 6/1971 | Moffett | 72/238 |
| 3,805,572 | 4/1974 | Busch | 72/238 |
| 4,702,099 | 10/1987 | Sturm | 72/238 X |
| 4,706,484 | 11/1987 | Dittmar et al. | 72/225 |

FOREIGN PATENT DOCUMENTS

| | | |
|---|---|---|
| 2701571 | 7/1978 | Fed. Rep. of Germany . |
| 2929423 | 2/1981 | Fed. Rep. of Germany . |

*Primary Examiner*—Robert L. Spruill
*Assistant Examiner*—Steven B. Katz
*Attorney, Agent, or Firm*—Foley & Lardner, Schwartz, Jeffery, Schwaab, Mack, Blumenthal & Evans

[57] ABSTRACT

In a beam mill stand having lower horizontal roll chocks, supported by screw-ups, upper horizontal roll chocks suspended on hooks from balance beams and urged downward by screw-downs, and vertical roll chocks supported by and moveable in transverse guide ways, in order to facilitate changing of the rolls as an interlocked stack, there are resilient support mechanisms in the upper horizontal roll chocks which are restrained by the hooks on the balance beams. With the mill stand inoperative, when the beams are lowered the resilient support mechanisms are released and extend to engage the vertical roll chocks to support the upper horizontal roll chocks resiliently. An interlocking mechanism in the vertical rolls is operated by the resilient support mechanism so that the vertical and lower horizontal roll chocks are locked against lateral movement.

9 Claims, 3 Drawing Sheets

ROLL CHANGE ARRANGEMENT FOR BEAM MILL STAND

FIELD OF THE INVENTION

This invention relates to a beam mill stand and is particularly concerned with the facilitation of roll changing.

BACKGROUND ART

In a beam mill stand, lower horizontal roll chocks are supported by a screw-up while upper horizontal roll chocks suspended on hooks from balance beams are urged downward by a screwdown. Also vertical roll chocks are supported by and moveable in transverse guide ways. Thus all four rolls are moveable, in use, to form a roll gap of desired section. It is desirable to remove or replace the four rolls and their chocks as a single stack. The aim being to reduce the down time when changing sets of rolls. As mentioned in the mill stand the chocks are separately supported, and it is not possible simply to let them all rest one on another because the upper rolls would rest on the lower rolls with consequent damage to them. In order to prevent such damage to the rolls, packers have been inserted both between the lower horizontal and the vertical rolls chocks and between the vertical and the upper horizontal roll chocks. These packers have to be inserted between the chocks with the stand in the mill line. This has been a laborious, time consuming and often dangerous operation.

SUMMARY OF THE INVENTION

An object of the present invention is to provide an arrangement for a beam rolling mill whereby the roll assemblies may be withdrawn from the mill as a stack.

According to one aspect the invention provides a beam mill stand comprising: upper and lower horizontal rolls rotatably supported in respective chocks; a pair of vertical rolls rotatably supported in respective chocks; resilient support means in the upper horizontal roll chocks, which, when the mill stand is inoperative, are capable of engaging the vertical roll chocks to resiliently support the horizontal roll chocks on the vertical roll chocks, with the upper and lower horizontal rolls in spaced apart relation.

According to another aspect the invention also provides a method of changing rolls of a beam mill having upper and lower horizontal rolls carried in respective roll chocks, and vertical roll carried in rolls chocks, comprising: (a) raising the lower horizontal roll chocks into supporting engagement with the vertical roll chocks, (b) resiliently supporting the upper horizontal roll chocks on the vertical roll chocks, which in turn are supported on the lower horizontal roll chocks, with the horizontal rolls in spaced apart relation to form a stack, and (c) withdrawing the roll stack from the mill stand.

DESCRIPTION OF THE PREFERRED EMBODIMENT

Figure 1:
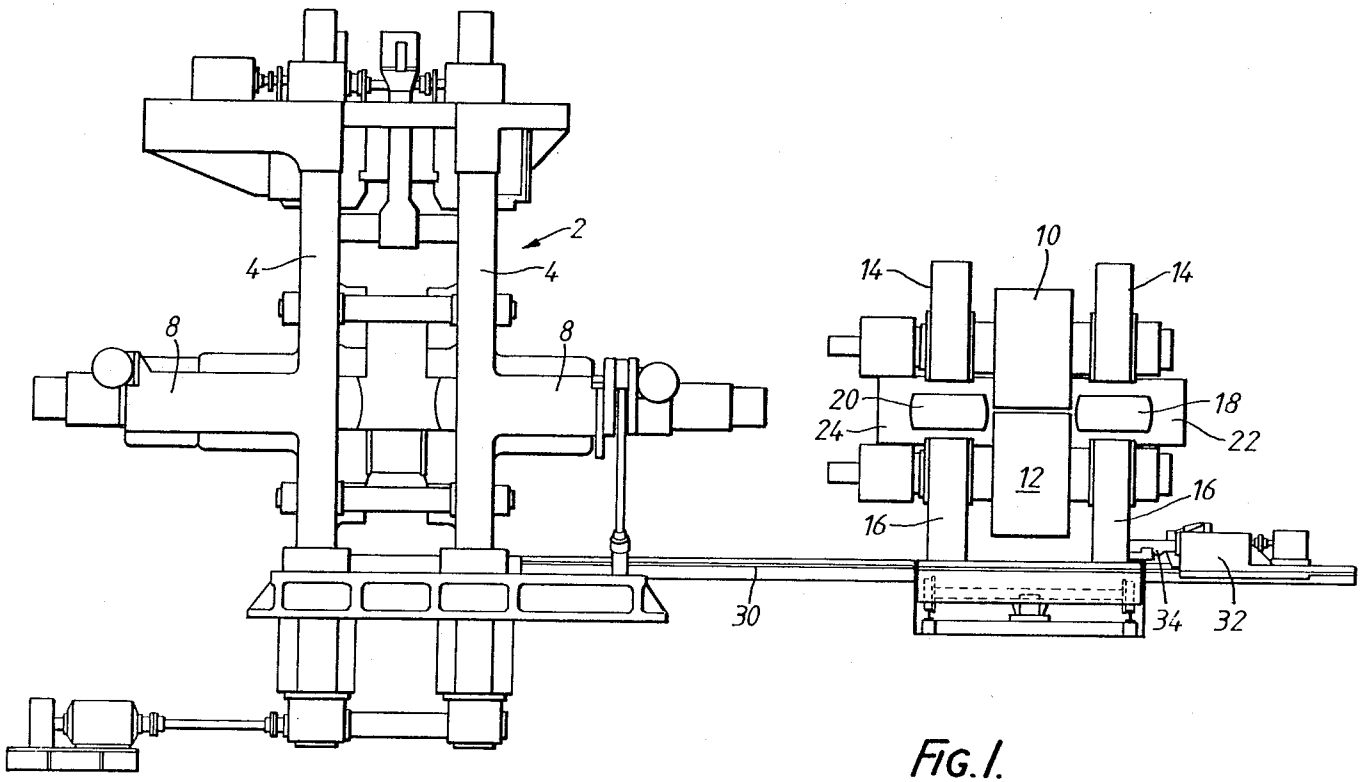
FIG. 1 is a general side view of a beam rolling mill stand showing a roll stack at a withdrawn position to one side.

A preferred embodiment of the invention will now be described by way of example, with reference to the accompanying drawings.

As seen in the drawings, a beam mill stand 2 has vertical housings 4 which define vertical housing windows 6. Integral, lateral extensions 8 on the outside of housings 4 provide horizontal housing windows. Horizontal rolls 10, 12 are rotatably supported in pairs of roll chocks 14, 16 respectively, and these chocks 14, 16 are vertically slideable within the housing windows 6. The upper roll chocks 14 are supported from housing 4 on balance beams 25 by means of depending hooks 26, hook faces **26*a* of which engage hook faces 28 on upper chocks 14. A screw down 15 is arranged above each upper chock 14 with lower bearing surface 15*a* of screw down 15 adjacent a top bearing surface 14*a* of roll chock 14. Vertical rolls 18, 20 have bearings in chocks 22, 24** which are slideably located in guideways in the horizontal housing windows. This configuration of a mill stand, windows and roll assemblies is well-known and quite conventional, and will not be described in detail further.

Adjacent the side of the stand are rails 30 and a tractor 32 having a hook connection at 34 which can engage with the bottom chock 16, as seen in FIG. 1, so that a stack of horizontal and vertical rolls in their chocks can be inserted into or withdrawn from the millstand 2, with the end of lateral housing 8 appropriately opened. Again this general configuration is well known.

In the mill stand according to the embodiment of the invention, each vertical roll chock 22, 24 has a pair of bores 36 which each receive a rod 38 which has a flange 40 which is located in a counterbore 42 in the underside of chock 22. At the bottom of each counterbore 42 a cover plate 44 is screwed to the bottom face of the chock 22 and is bored to allow a lower end extension 46 of rod 38 to pass therethrough. Between the plate 44 and the flange 40 are located a number of Belleville washers 48. About the top of each bore 36 is formed raised C-shaped lug 37, which thus forms a raised arc about the upper opening of bore 36.

Figure 4:
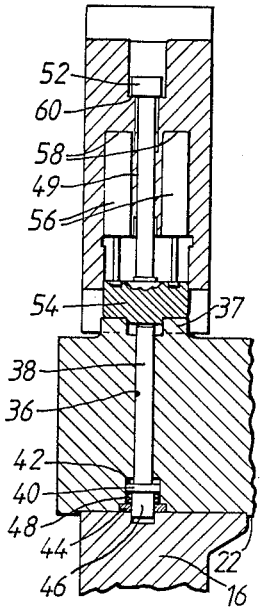
FIG. 4 is a section view on the line IV—IV of FIG. 3, of part of the roll assemblies.

Referring now particularly to FIG. 4, each top horizontal roll chock 14 has a pair of bores 49 one at each side of the chock, which each receive a vertical rod 50. Each rod 50 has a head 52 at its upper end with lateral hook **52*a*, and at the lower end of each rod is fixed a crosshead 54 with central underside projection 54*a*. As seen in FIG. 4, on either side of the vertical rod 50 is located a type of piston and cylinder unit known in the industry and referred to as a Jarrett buffer 56 which essentially uses an elastomer as the resilient material. The piston rod of each buffer is secured to the crosshead 54, and the cylinder parts are located in the chock 14 engaged against shoulders 58** on the chock.

Figure 2:
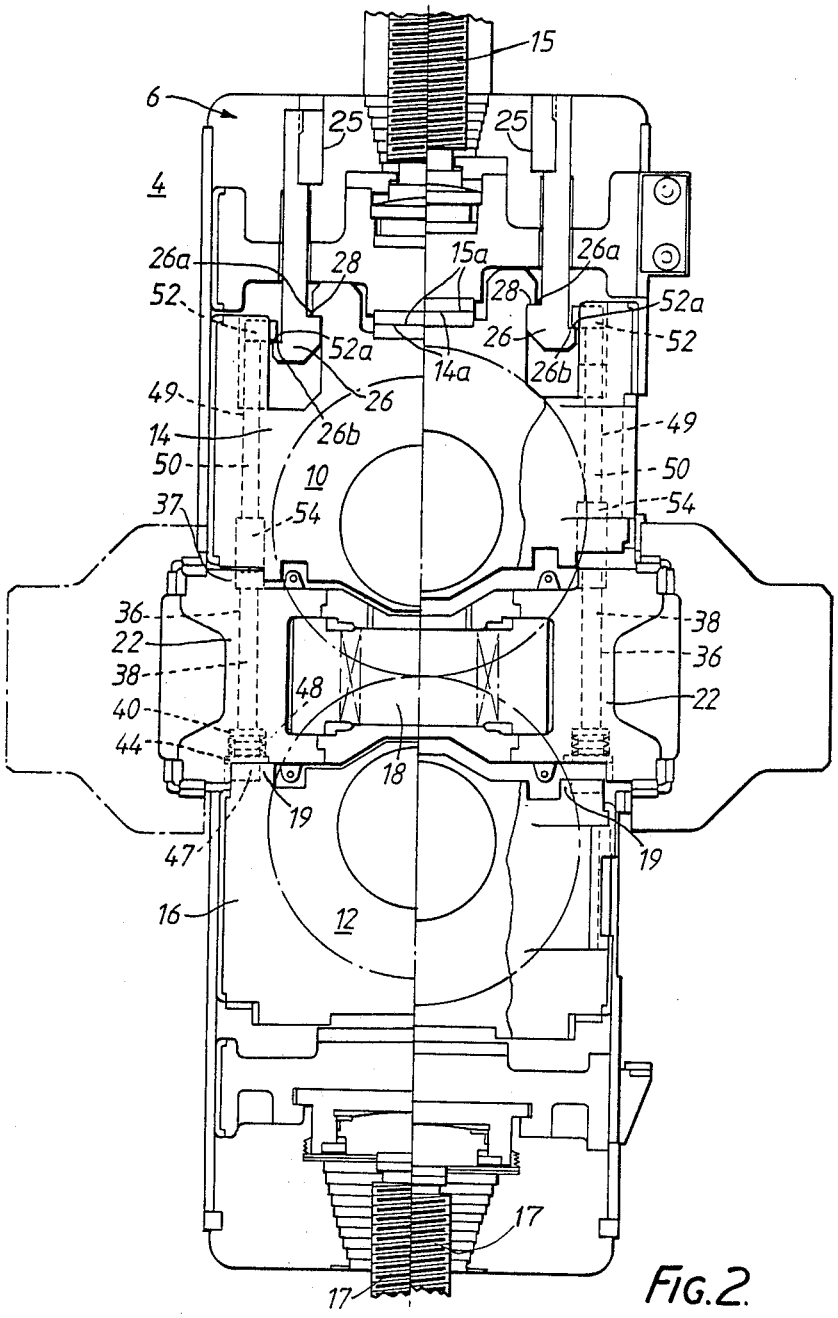
FIG. 2 is a side view of the mill stand with the rolls in working position, partially cutaway and showing in phantom, maximum and minimum horizontal roll diameters.
Figure 3:
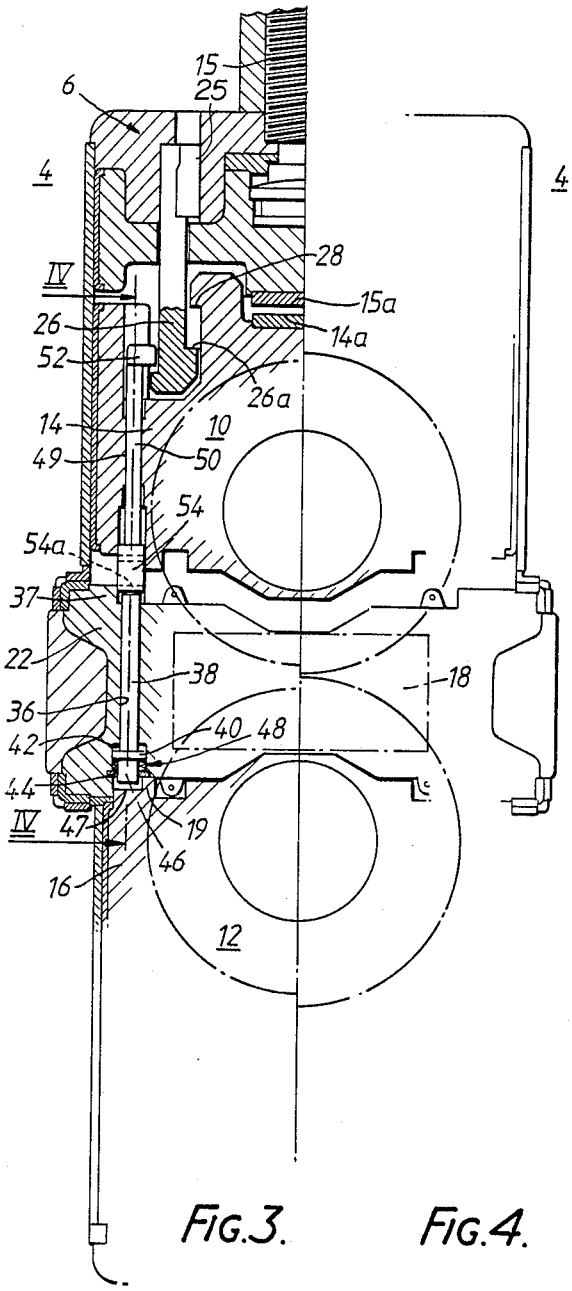
FIG. 3 is a similar view to FIG. 2, but in section with the roll assemblies in their roll change position.

The procedure for roll change will now be described starting from the condition shown in FIG. 2 where the mill stand is in an operative condition.

The upper horizontal roll chocks 14 are held on hooks 26 by balance beams 25 against the force of screw-down 15. The lower horizontal chocks 16 are supported, and urged upwards by screw-up 17. The vertical roll chocks are similarly urged inwards by screw-ins, in a conventional manner. At the termination of rolling the loads on the chocks will be reduced so that they rest, generally as shown in FIG. 2, spaced apart with the vertical roll chocks supported in guideways in the lateral extensions 8 of housing 4 and the upper and lower horizontal roll chocks supported, as described above, by balance beams 25 and screw-up 17, respectively.

At this stage, in each vertical chock 14 each rod 38 will be supported in corresponding bore 36, by the Belleville washers 48, so that the lower end extension 46 will be withdrawn in the counterbore 42, in ambush, while the upper end of end rod 38 projects into the semicircular arc of C-shaped lug 37. Meanwhile in the upper horizontal chocks 14 each rod 50 will be withdrawn within that chock by the hook face 26*b* of hook 26 engaging with hook face 52*a* of head 52 on rod 50. At the top of the range of movement of hook 26 the rod 50 is fully withdrawn (FIG. 2). The Jarrett buffers 56 are at full compression. At this stage it should be noted the support of the upper horizontal roll chock 14 is through the hook face 26*a* engaging with hook face 28 on roll chock 14. The roll change procedure can then commence as follows.

1. The lateral positions of the vertical roll chocks are adjusted to bring the bores 36 and respective rods 38 into alignment between the lower end of the respective crosshead 54 in upper horizontal roll chocks 14 and a respective recess 47 in lower horizontal roll chocks 16. If necessary, lateral adjustment may be affected to bring the upper and lower horizontal chocks into alignment. Normally however this will not be necessary.

2. The screw-down 15 is released to allow balance beam 25 to drawn up the upper horizontal roll chock to separate the horizontal rolls by a predetermined amount.

3. The lower horizontal roll chocks are then raised up by means of screw-ups 17 so that lugs 19 engage with the vertical roll chock above so that that chock is supported on the lower horizontal roll chock beneath. The vertical roll chocks are thus supported by the lower horizontal roll chocks.

4. The upper horizontal chocks 14 are then lowered on hooks 26, with screw-downs 15 inoperative. For each chock, once the surface of screw-down 15 and the upper horizontal roll chock have separated, the hook faces 26*a* and hook faces 28 on that chock will disengage, so that that chock will be supported on hooks 26 through hook faces 26*b* by the rods 50 and Jarret buffers 56. As mentioned the Jarrett buffers will be fully compressed, so that as hook 26 is lowered further the compression due to the upward force of hooks 26 will be eased and buffers expand. The result of this will be that in each chock the pair of rods 50 and crossheads 54 will move downwards relative to the chock, and the crossheads will project below the bottom of the chock 14. Eventually the compression of the buffers due to upward restraint of the hooks 26 will be released and expansion of the buffers will cease, with the head 52 of rod 50 engaging ledge 60. As the hook is lowered further each chock will be carried through the Jarrett buffers which are chosen to be able to support the weight of the upper chock.

5. As the upper chocks are lowered with the crossheads 54 projecting below the chock, the projection 54*a* on the underside of each crosshead 54 will engage the top of rod 38 and depress that rod, compressing the Belleville washers 48. The lower end extension 46 of rod 38 will thus be pressed down into recess 47 in the lower horizontal roll chock 16. The crosshead 54 will eventually engage with lug 37 and at that stage the hook 26 will disengage from the head 54 on rod 50, leaving the upper horizontal roll chock resiliently supported on the vertical roll chock by means of the Jarrett buffers 56 and the crosshead 54.

6. The upper and lower horizontal roll chocks and the vertical roll chocks are now in an interlocked stack. The lower end extension 46 of each rod 38 engaged in corresponding recess 47 in the lower horizontal roll chock to secure the vertical roll chocks and the lower horizontal roll chocks against lateral movement, while the same function is performed between the upper horizontal roll chocks and the vertical roll chocks by means of the crossheads 54, and in particular the underside projection 54*a* engaging in C-shaped lug 37. Furthermore the upper horizontal roll chocks are resiliently supported, spaced apart from the vertical chocks, by the Jarrett buffers 56. That spacing apart ensures the horizontal rolls avoid contact with each other—it will be remembered that the lower horizontal roll chock, and corresponding roll, have been raised up. The resulting roll stack may be withdrawn sideways from the stand, as previously discussed, with the stack safely interlocked and rolls separated as necessary.

The installation procedure is essentially the reverse of the normal procedure described. With stack inserted, the upper roll chocks are raised, resiliently supported through the Jarrett buffer 56, by hooks 26 until the co-operating surfaces of screwdowns 15 and roll chocks 14 engage, limiting further upward movement of the chocks. However upward movement of the hooks 26 continues, compressing the Jarrett buffers until the crossheads 54 are fully withdrawn. Upward movement of the hooks 26 is limited by engagement with hooks 28 on the chocks 14. Meanwhile the rods 38 will have been urged upward by the Belleville washers 48, as the crossheads 54 are removed. The vertical and lower horizontal roll chocks are thus disengaged. The lower horizontal roll chocks can then be lowered to working position, and the upper roll chocks can then be brought down to the working pass line by the screw downs.

Variations can be made to the described structure, without departing from the inventive concept, for example resilient members other than the elastomers 56 might be used, and the shape of the locating lugs 37, 19 can readily be varied.

What is claimed is:

1. A beam mill stand, comprising:

a housing;

pairs of upper and lower horizontal roll chocks slidably supported in the housing;

upper and lower horizontal rolls rotatably supported in respective chocks;

vertical roll chocks slidably supported in the housing;

a pair of vertical rolls rotatably supported in respective chocks; and resilient support means for resiliently supporting the upper horizontal roll chocks and the upper horizontal roll on the vertical roll chocks, including engagement means movable between an inoperative position where the engagement means is retracted into the upper horizontal roll chocks, and an operative position where the engagement means is displaced to engage the vertical roll chocks; resilient means for displacing the engagement means from the inoperative position to the operative position; and retraction means operative to hold the engagement means retracted in the inoperative position, against the urging of the resilient means; whereby when the retraction means is inoperative the engagement means is released to be urged by the resilient means to the operative position into engagement with the vertical roll chocks, the upper horizontal roll chocks being resiliently supported on the vertical roll chocks by the resilient means through the engagement means.

2. A beam mill stand as claimed in claim 1, wherein the mill stand further comprises a screw-down from downwardly urging the upper horizontal roll chocks, a balance beam structure for restraining the upper horizontal roll chocks onto a screw-down, and the balance beam structure forming part of the retraction means.

3. A beam mill stand as claimed in claim 1, wherein the resilient support means has an interconnecting means for releasably engaging the retraction means.

4. A beam mill stand as claimed in claim 1, wherein the resilient support means engage the engagement means to restrain the upper horizontal and vertical roll chocks against relative lateral movement.

5. A beam mill stand as claimed in claim 1, wherein the vertical roll chocks have interlocking means for interlocking the vertical roll chocks and adjacent lower horizontal roll chocks against relative lateral movement, by the resilient support means being brought to an operative, vertical roll engaging condition.

6. A method of changing rolls of a beam mill stand having upper and lower horizontal rolls carried in respective roll chocks, and vertical rolls carried in roll chocks, comprising the steps of: (a) raising the lower horizontal roll chocks into supporting engagement with the vertical roll chocks, (b) resiliently supporting the upper horizontal roll chocks on the vertical roll chocks, which in turn are supported on the lower horizontal roll chocks, with the horizontal rolls in spaced apart relation to form a stack, said resilient support step being performed by means including engagement means movable between an inoperative position where the engagement means is retracted into the upper horizontal roll chocks, and an operative position where the engagement means is displaced to engage the vertical roll chocks; resilient means for displacing the engagement means from the inoperative position to the operative position; and retraction means operative to hold the engagement means retracted in the inoperative position, against the urging of the resilient means; and (c) withdrawing the roll stack from the mill stand.

7. The method of claim 6, further comprising the step of:

laterally adjusting the vertical roll chocks.

8. The method of claim 7, further comprising the step of:

determining the necessity for lateral adjustment of the upper and lower horizontal chocks.

9. The method of claim 8, further comprising the step of:

securing the vertical roll chocks and the lower horizontal roll chocks against lateral movement.

* * * * *